US006338163B1

(12) United States Patent
Markson

(10) Patent No.: US 6,338,163 B1
(45) Date of Patent: Jan. 15, 2002

(54) INTEGRAL CONVERTIBLE GLOVE ASSEMBLY

(75) Inventor: Peter Markson, New York, NY (US)

(73) Assignee: Paris Accessories, Inc., New York, NY (US)

( * ) Notice: Subject to any disclaimer, the term of this patent is extended or adjusted under 35 U.S.C. 154(b) by 0 days.

(21) Appl. No.: 09/672,155

(22) Filed: Sep. 27, 2000

(51) Int. Cl.[7] ..... A41D 19/00
(52) U.S. Cl. ..... 2/163; 2/161.6
(58) Field of Search ..... 2/158, 159, 160, 2/161.1, 161.6, 163, 169, 170

(56) References Cited

U.S. PATENT DOCUMENTS 4,383,336 A * 5/1983 Beckman et al. ..... 2/158
4,543,671 A * 10/1985 Monk ..... 2/158
4,651,350 A * 3/1987 Dawiedczyk ..... 2/158
5,509,143 A * 4/1996 Yates et al. ..... 2/160
5,515,547 A * 5/1996 Middleton ..... 2/158
5,542,125 A * 8/1996 Zuckerwar ..... 2/158
5,617,583 A * 4/1997 Yates et al. ..... 2/160
5,774,894 A * 7/1998 Yates et al. ..... 2/158

* cited by examiner

*Primary Examiner*—John J. Calvert
*Assistant Examiner*—Katherine Moran
(74) *Attorney, Agent, or Firm*—Barry G. Magidoff; Paul J. Sutton

(57) ABSTRACT

There is disclosed herein a convertible glove assembly adapted to be configured as a conventional, hand encompassing glove unit or as a partial hand encompassing unit wherein the fingers of the wearer (excepting the thumb) are exposed. The device includes a palm portion terminating in four tubular extensions and a finger portion having four finger encompassing sacs adapted to be folded into registry with the tubular extensions of the palm portion. A flap or band on the finger portion overlaps extensions of the palm portion to provide full leak resistant closure. In accordance with a first embodiment, Velcro Brand Fastener components may be interposed between the flap and palm. In a further embodiment the back of one or more of the finger sacs and the back of the palm portion adjacent the cuff are provided with complemental Velcro Brand Fastener connections whereby the finger sacs are maintained in a folded back condition.

5 Claims, 2 Drawing Sheets

INTEGRAL CONVERTIBLE GLOVE ASSEMBLY

BACKGROUND OF THE INVENTION

The present invention is directed to a glove assembly and, more particularly, to a glove device adapted to be converted from a first condition in which the entire hand is encompassed by the glove and a second condition in which the fingers (excepting the thumb) extend from the glove as would be desired where accurate tasks are to be performed without the encumbrance of the fabric or leather of the glove.

PRIOR ART

Conventional glove structures encompass the entire hand of the wearer. It is known to provide a "partial glove" wherein the endmost portions of the fingers are exposed.

In a further known construction, a mitten-like device is provided with a transversely-extending slit in the area of the palm whereby the fingers of the wearer may selectively be extended through the slit or remain encompassed within the sac-like enclosure of the mitten.

SUMMARY OF THE INVENTION

The present invention is directed to an integral glove device characterized in that it may be converted from a construction which encompasses the entirety of the hand including the fingers or, by folding back the portion of the device remote from the cuff, the fingers (excepting the thumb) may be exposed. A further novel aspect of the device resides in the ability, in contrast to known prior art devices, to afford a complete and essentially leak-proof enclosure of the hand when the device is worn in the manner of a conventional glove.

In accordance with an embodiment of the invention, means are provided for holding the finger components in the folded back condition.

Briefly stated, the device includes a sleeve having a cuff at one end, the sleeve being tubular and extending toward the finger portion. The sleeve includes a conventional thumb encircling branch. Projecting from the end of the sleeve remote from the cuff are four tubular extensions. A finger assembly includes four finger sacs, each said sac being in registry with a respective tubular extension of the sleeve component. The finger assembly includes a closure band which extends from the finger assembly toward the cuff end. The closure band overlaps the tubular extensions of the sleeve component blocking a passage of air into the interior. The device may be worn as a conventional glove, or the finger components may be folded back, the wearer's fingers projecting through the tubular extensions of the sleeve component.

Optionally, a connector means such as Velcro Brand Fastener may be interposed between the closure band and the surface of the sleeve assembly opposed to the band.

Also, in a preferred embodiment, Velcro Brand Fastener components may be fixed respectively to the back of the glove and the back of one or more of the fingers, enabling the finger encompassing components to be held in a folded-back condition.

DETAILED DESCRIPTION OF DRAWINGS

Figure 1:
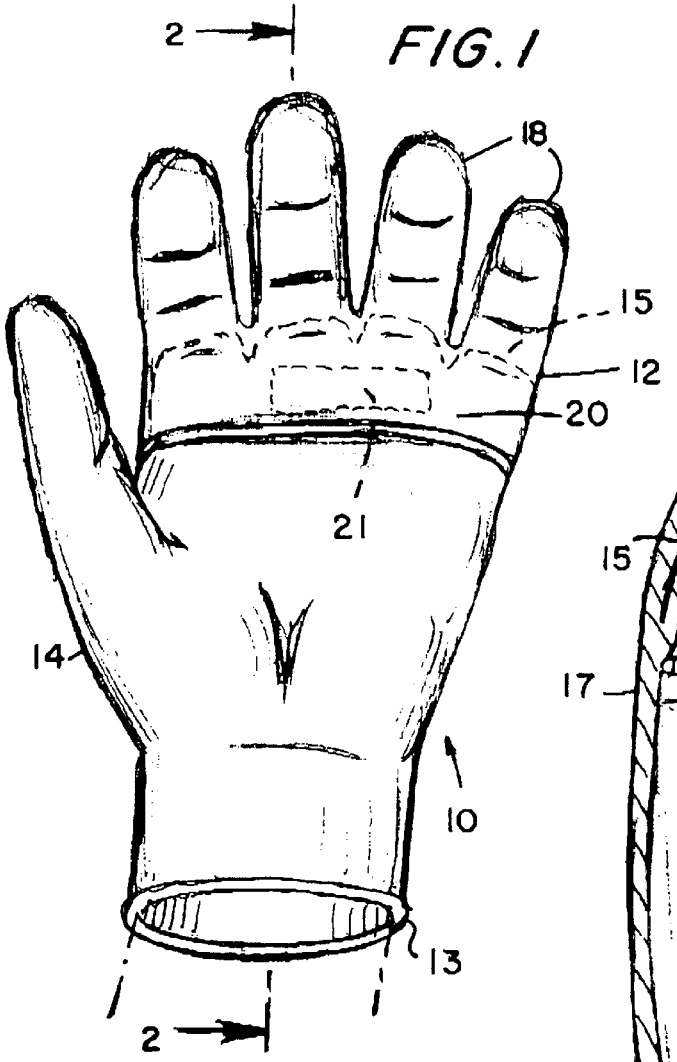
FIG. 1 is a perspective view of a glove in accordance with the invention.

Referring to the figures, there is disclosed a convertible glove device (10) which is comprised of a palm-unit (11) and a finger assembly (12). It will be readily recognized that the glove material may comprise leather, wool, or any similar material.

The palm unit is generally tubular including a cuff-end (13). As is conventional, thumb extension (14) projects from the sleeve.

The end of the palm unit remote from the cuff (13) is formed with a series of four tubular extensions (15).

Figure 2:
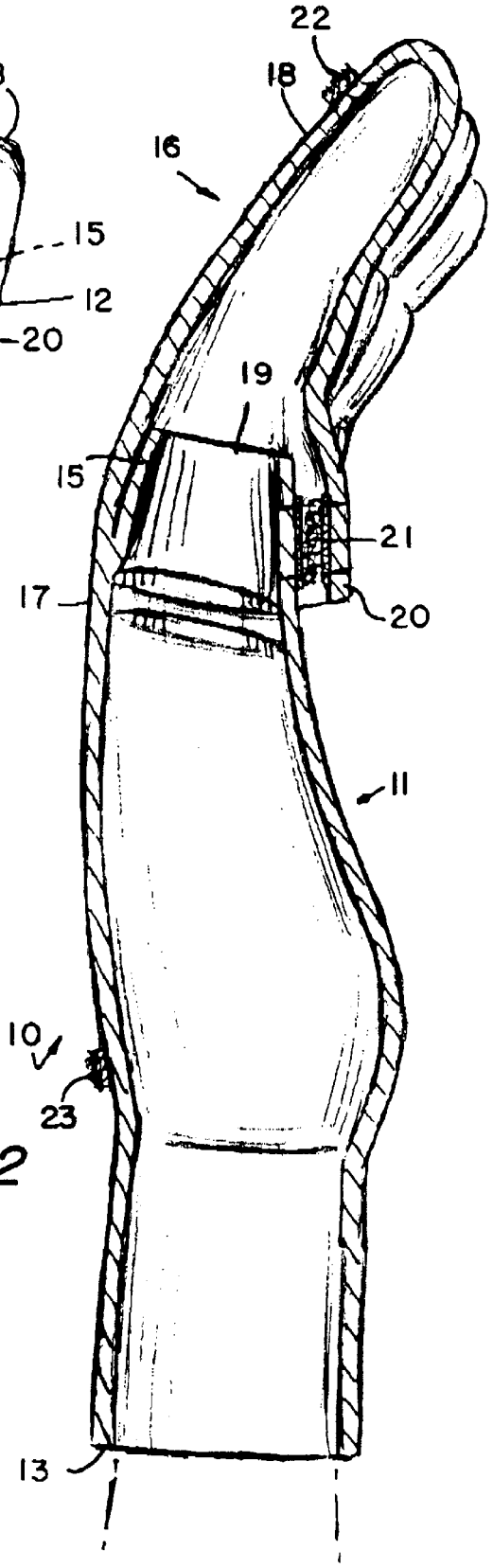
FIG. 2 is an enlarged vertical sectional view taken on the lines 2—2 of FIG. 1.

The finger assembly (12) is integrally formed with the palm unit (11), the palm and finger assemblies being joined at hinge area (17). The finger assembly includes essentially conventional finger encompassing sacs (18). The open ends of the finger sacs (18) are disposed in registry with open-mouth portions (19) of the palm assembly. The finger assembly includes a closure band or flap 20 which overlaps the tubular extensions of the palm component in the handencompassing configuration of the glove as illustrated in FIG. 2. Optionally, reclosable connector means (21), such as Velcro Brand Fastener, may be disposed between band (20) and the sleeve component of the device.

Figure 3:
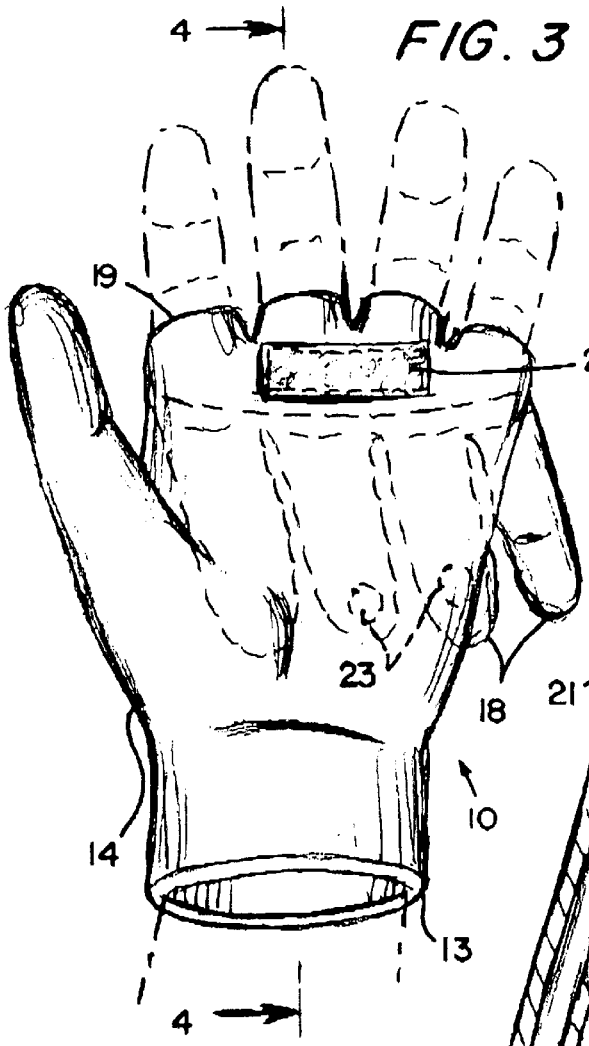
FIG. 3 is a front perspective view similar to FIG. 1 illustrating the glove in the "finger exposed" condition.

In accordance with a preferred embodiment, one or more of the back portions of the finger sacs 18 adjacent the top of the sac is provided with a Velcro Brand Fastener dot 22, complemental dots 23 being affixed to the back of the glove adjacent the cuff. This arrangement enables the finger components to be held out of the way against the back of the glove (solid lines FIG. 3).

Figure 4:
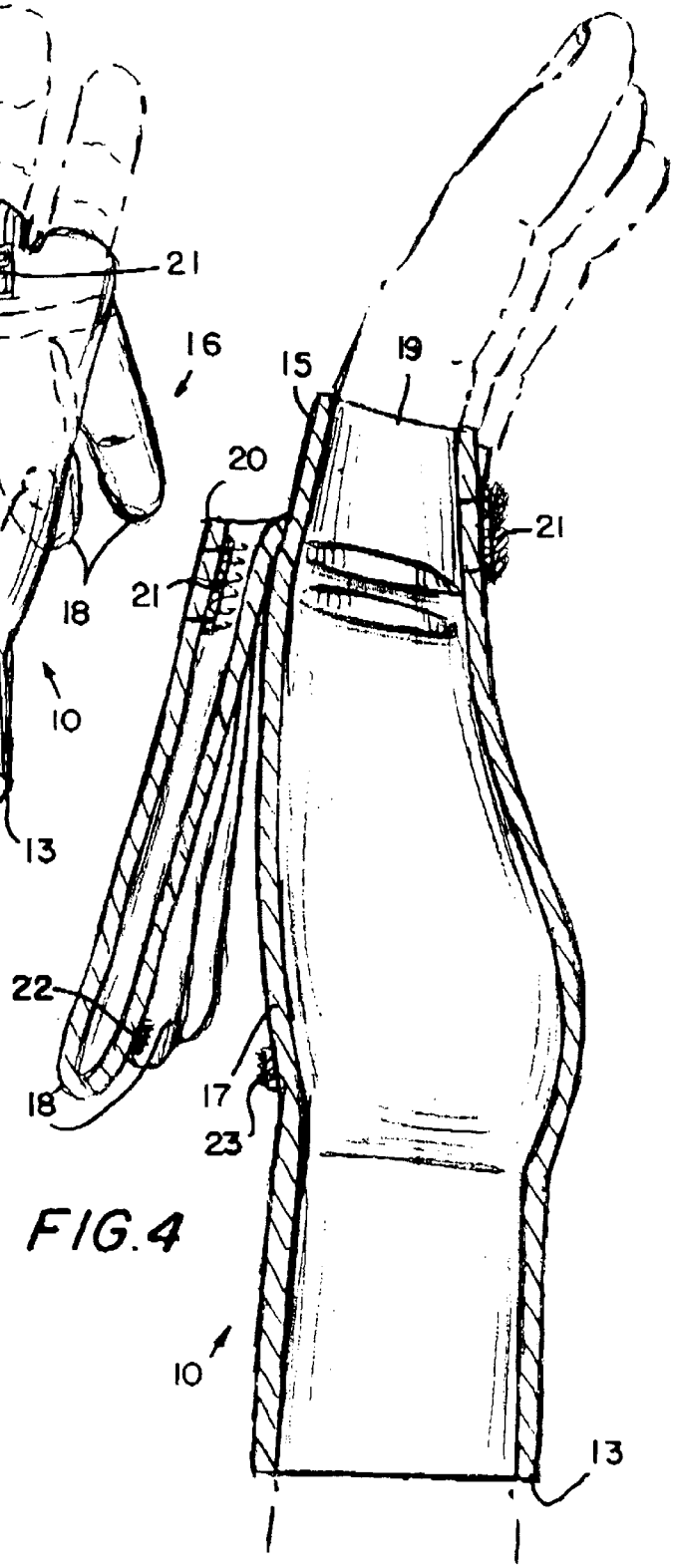
FIG. 4 is an enlarged vertical section taking on the line 4—4 of FIG. 3.

The functioning of the device will be evident from the preceding disclosure. In a full hand encompassing condition illustrated in FIG. 2 the device functions in the manner of a conventional glove. If it desired to have the fingers free, as for the performance of tasks requiring a high-degree of finger dexterity, the finger components (12) are folded backwardly from the position from the position of FIG. 2 to the position illustrated in FIGS. 3 and 4 such that the fingers of the wearer are exposed. The overlapping band or flap (20) assures that in the glove-defining condition the interior of the glove is sealed. The sealing effect is augmented, if desired, by the provision of a Velcro Brand Fastener or like connector interposed between the flap and the palm unit. Velcro Brand Fastener may also be employed to hold the finger sacs in a fold back position.

As will be apparent to those skilled in the art and familiarized with the instant disclosure numerous variations of structural details may be made without departing from the spirit of the invention. Accordingly, the invention is to be broadly construed within the scope of the appended claims.

What is claimed is:

1. An integral convertible glove assembly comprising a palm unit including a sleeve having a cuff encircling portion at one end, a thumb extension projecting from said sleeve in spaced relation to said one end, the end of said sleeve remote from said cuff encircling portion including four tubular extension members, said extension members being generally aligned with the longitudinal axis of said sleeve, said extension members including open-mouth portions directed away from said one end, a finger assembly hingedly connected to said sleeve, said finger assembly including four finger sacs, each said finger sac having an open end in registry with a mouth portion of a respective said tubular extension, said finger assembly including a closure band extending toward said one end, said band being disposed in overlapping relation of said extension members, whereby the fingers of a wearer may selectively extend through said extension members and into said sacs or through said extension members only.

2. A glove assembly in accordance with claim 1 and including releasable connector means interposed between said closure band and opposed portions of said sleeve for releasably binding said band to said sleeve.

3. A glove assembly in accordance with claim 2 when said connector means comprises Velcro Brand Fastener.

4. A glove assembly in accordance with claim 1 and including a first fastener component affixed to the back surface of at least one said finger sac, a second complemental fastener components affixed to the back of said sleeve adjacent said cuff encircling portion said fastener component, when interconnected, being adapted to hold said finger sacs against back of said cuff encircling portion.

5. A glove assembly in accordance with claim 4 wherein said fastener components comprise Velcro Brand Fastener.

* * * * *